United States Patent [19]

Yamazaki et al.

[11] Patent Number: 4,785,324

[45] Date of Patent: Nov. 15, 1988

[54] ELECTROPHOTOGRAPHIC APPARATUS AND METHOD FOR PREVENTING THE LOWERING OF A CHARGING VOLTAGE AT A PHOTORECEPTOR

[75] Inventors: Mutsuki Yamazaki; Eiichi Kaga, both of Yokohama, Japan

[73] Assignee: Kabushiki Kaisha Toshiba, Kawasaki, Japan

[21] Appl. No.: 25,588

[22] Filed: Mar. 13, 1987

[30] Foreign Application Priority Data

Mar. 26, 1986 [JP] Japan ..... 61-67925
Mar. 26, 1986 [JP] Japan ..... 61-67926

[51] Int. Cl.[4] ..... G03G 15/00

[52] U.S. Cl. ..... 355/3 R; 355/15; 118/652

[58] Field of Search ..... 355/15, 3 TR, 77; 118/3 R, 652; 430/125

[56] References Cited

U.S. PATENT DOCUMENTS

| | | | |
|---|---|---|---|
| 3,526,457 | 9/1970 | Dimond et al. | 355/15 |
| 3,778,148 | 12/1973 | Fujitsuka et al. | 355/15 |
| 3,819,262 | 6/1974 | Estandarte | 355/15 |
| 3,838,921 | 10/1974 | Sargis | 355/15 |
| 4,158,498 | 6/1979 | Ohmori | 355/15 |
| 4,233,386 | 11/1980 | Aizawa et al. | 355/15 X |
| 4,660,962 | 4/1987 | Maekawa et al. | 355/15 |
| 4,674,865 | 6/1987 | Tada et al. | 355/15 |

FOREIGN PATENT DOCUMENTS

| | | | |
|---|---|---|---|
| 60-238884 | 11/1985 | Japan | 355/15 |
| 61-04677 | 3/1986 | Japan | 355/15 |

*Primary Examiner*—R. L. Mosses

*Attorney, Agent, or Firm*—Foley & Lardner, Schwartz, Jeffery, Schwaab, Mack, Blumenthal & Evans

[57] ABSTRACT

A photoreceptor of amorphous silicon is provided on the surface of a cylindrical drum. A charger, exposing unit, developing unit, transfer charger, separation charger, discharger and cleaning blade are located, in that order, around the cylindrical drum. A light shielding plate is located close to that surface of the discharger where the first-mentioned charger is positioned. The surface of the photoreceptor is charged, while the cylindrical drum is rotated, and then exposed to light to form an electrostatic latent image on that surface. A toner is supplied from the developing unit to the surface of the photoreceptor to develop the latent image into a visual image. The visual image is transferred by the transfer charger to a copying sheet, and the copying sheet is separated by the separation charger off the photoreceptor. Thereafter, the image transfer area of the photoreceptor is discharged by light from a discharging lamp in the discharger and the toner remaining on the surface of the phtotreceptor is removed by a cleaning blade.

20 Claims, 3 Drawing Sheets

ELECTROPHOTOGRAPHIC APPARATUS AND METHOD FOR PREVENTING THE LOWERING OF A CHARGING VOLTAGE AT A PHOTORECEPTOR

BACKGROUND OF THE INVENTION

This invention relates to an electrophotographic apparatus and method for preventing a charging potential at a photoreceptor from being decreased.

In an electrophotographic apparatus, such as an ordinary photo copying machine and laser beam printer, the surface of a photoreceptor is charged through a corona discharge, and either one of an electron and hole in a pair created in the photoreceptor upon an image exposure is neutralized with a charge on the surface of the photoreceptor to form an electrostatic latent image on the surface of the photoreceptor. The latent image is developed into a visual image by depositing a toner on the latent image area of the photoreceptor in which case the toner is charged with a polarity opposite to that of the charge on the surface of the photoreceptor. Then the developed image is transferred to a copying sheet to obtain a copy image on the copying sheet. After the toner on the surface of the photoreceptor has been removed therefrom, the latent image on the surface of the photoreceptor is erased in readiness for the next image forming cycle. This step is called as a discharging step. This discharging step is performed by generally illuminating the whole surface of the photoreceptor with light.

As a material for the photoreceptor, use may be made of a chalcognide series, such as selenium, and an organic semiconductor, such as polyvinyl carbazole (PVK), but these materials have a low sensitivity to a visible light ray. These materials have a lower strength, a lower temperature stability, etc., as well as a shorter service life when they are applied to the electrophotographic photoreceptor.

Recently attention has been paid to amorphous silicon (hereinafter referred to as a-Si) which is employed as a material for the photoreceptor. The a-Si represents a high and panchromatic sensitivity, an excellent temperature stability, a higher Vickers' hardness of about 1000 and a longer service life. The electrophotographic apparatus employing a photoreceptor including a-Si can reduce the time taken for one step of electrophotography, in comparison with that taken on a conventional apparatus. This advantage is obtained particularly from the broader photosensitive wavelength range and higher spectral sensitivity. That is, the photoreceptor of the a-Si is effective for a high-speed copying operation.

In the conventional copying process, however, if use is made of the a-Si type photoreceptor, a charging potential level on the photoreceptor is significantly lowered at the discharging step.

This is a phenomenon inherent in the a-Si. When, in the band gap, electrons are induced at a localized level in the neighborhood of a conduction band, they do not promptly neutralize charges at the surface of the photoreceptor. When the electrons are further excited by heat and rise above the localized level, they neutralizes the charges.

Hence, the electrons excited at the localized level through the absorption of the light component of a long waveform of the discharge light do not contribute to the discharging and, after having been excited thermally, neutralize ions at the next charging step. If, in particular, the charging and discharging means are located in proximity to each other, this phenomenon promptly emerges due to the ready light leakage onto the photoreceptor surface.

As a result even if, in the next charging step, the same voltage as a previous one is applied, only 50% to 80% of that charging voltage generated in the dark is obtained. If, therefore, the charging voltage is thus lowered, then the image contrast becomes smaller, resulting in a poorer image quality.

SUMMARY OF THE INVENTION

It is, accordingly, an object of the present invention to provide an electrophotographic apparatus and method for preventing the lowering of a charging voltage at a photoreceptor which may occur at a discharging step.

An electrophotographic apparatus according to an aspect of the invention comprises a photoreceptor including amorphous silicon, charging means for charging a surface of the photoreceptor, means for forming an electrostatic latent image on the surface of the photoreceptor, means for developing the latent image by a developing agent into a visible image, means for transferring the visible image to a copying sheet, means for removing the developing agent which remains on the surface of the photoreceptor after the image has been transferred by the transfer means, and means for discharging that surface area of the photoreceptor illuminated by light, said discharging means discharging the surface area of the photoreceptor earlier than the removal of the remaining agent on the surface of the photoreceptor by said removing means.

An electrophotographic apparatus according to an another aspect of the invention comprises, a photoreceptor including amorphous silicon, means for charging a surface area of the photoreceptor, means for forming an electrostatic latent image on the surface area of the photoreceptor means for developing the latent image by a developing agent into a visual image, means for transferring the visual image onto a copying sheet, means for removing the agent remaining on the surface area of the photoreceptor after the image transfer has been performed by said transfer means, discharging means for discharging the surface area of the photoreceptor through a light illumination, and light shielding means for shielding the light directed from said discharging means onto the surface area of the photoreceptor which has been charged by said removing means.

An electrophotographic method according to the invention comprises the steps of, charging a surface of a photoreceptor comprising amorphous silicon, exposing the surface of the photoreceptor to light to form an electrostatic latent image on the surface of the photoreceptor, applying a developing agent to the surface of the photoreceptor image to develop the electrostatic latent image into a visible image, transferring the visible image onto a copying sheet, illuminating the surface of the photoreceptor by light to discharge the illuminated area of the photoreceptor, and removing the agent deposited on the illuminated area of the photoreceptor so that said surface area of the photoreceptor is cleaned.

According to the present invention it is possible to extend a time from the discharging of the photoreceptor surface to the subsequent charging of it and/or it is also possible to prevent leakage of discharging light toward that charged surface area of the photoreceptor. As a result, it is possible to suppress a fall in the charging voltage of the photoreceptor.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, in which.

DETAILED DESCRIPTION OF THE PREFERRED EMBODIMENTS

Figure 1:
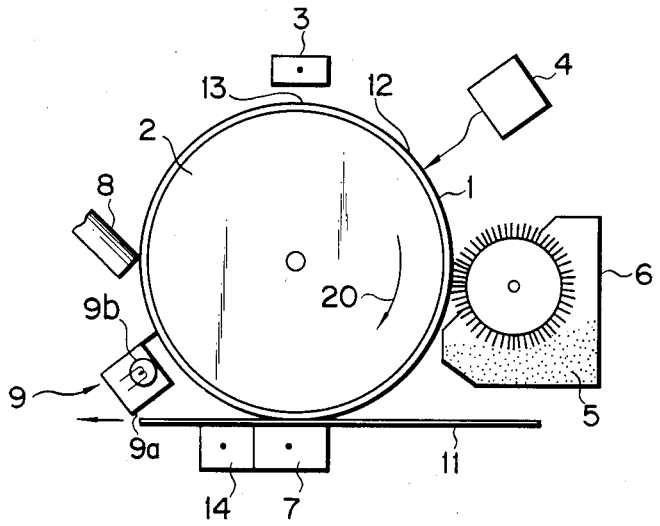
FIG. 1 is a schematic explanatory diagram showing an arrangement of the component parts of an electrophotographic apparatus according to the present invention.

The present invention will now be described in detail below with reference to FIG. 1 to FIG. 4. The same parts or portions are designated by the same reference numerals.

Referring now to FIG. 1, photoreceptor 1 of a-Si is formed on the surface of drum 2, and drum 2 is rotated by a driving means, not shown, in a direction as indicated by an arrow 20 in FIG. 1. Charger 3, for charging the surface of photoreceptor 1 to form charged area 13 thereon, exposure unit 4 for emitting image light 12, developing unit 6 for developing an electrostatic latent image by toner 5 into a visible image, transfer charger 7 for transferring a developed image to copying sheet 11, separating charger 14, discharger 9 having box 9*a* for holding discharging lamp 9*b* for emitting discharging light onto the surface of photoreceptor 1, and cleaning blade 8 for removing a residual toner on the surface of the photoreceptor are arranged, in that order, around the drum 2.

In the apparatus as set forth above, the photoreceptor, while being rotated on drum 2, has its surface charged by charger 3 to form a charged area 13. Then an electrostatic latent image is formed by the image light exposure, and toner 5 is supplied from developing unit 6 onto the surface of photoreceptor 1 to develop the electrostatic latent image into a visual image. The visual image is transferred by transfer charger 7 onto copying sheet 11. Sheet 11 is then separated by separating charger 14. Then light is directed by the discharging lamp onto the surface of photoreceptor 1 to discharge the surface of photoreceptor 1. Thereafter, the residual toner 5 on the surface of photoreceptor 1 is removed by cleaning blade 8. In this case, the discharging of the photoreceptor surface is effected earlier than the cleaning of the surface of the photoreceptor, making it possible to extend the time from the discharging to the charging of the photoreceptor. For this reason, the major portion of carriers generated by a light illumination in the photoreceptor may be recombined until it reaches charged area 13, reducing carrier density in charged area 13 and hence the percentage of charging potential will be lowered.

The modification of this embodiment will now be explained below with reference to FIGS. 2, 3 and 4.

Figure 2:
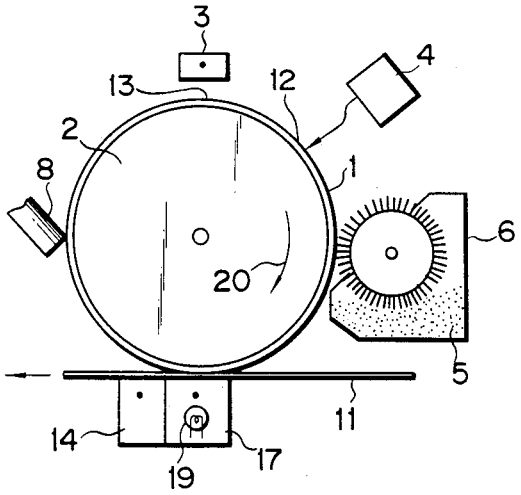
FIGS. 2, 3 and 4 are schematic explanatory diagrams showing an arrangement of the component parts of an electrophotographic apparatus according to a modification of the embodiment shown in FIG. 1.

As shown in FIG. 2 discharging lamp 19 is placed inside transfer charger 17 and light is directed to a photoreceptor from behind copying sheet 11 in which case the surface area of photoreceptor 1 can be discharged, simultaneously with a transferring step, due to the a-Si portion of the photoreceptor being high in sensitivity. This specific arrangement may further extend the time taken from the discharging step to the next charging step. Discharger 9 and transfer charger 17 equipped with discharging lamp 19 are both provided in this modification. Both dischargers 9 and 17 are employed for a copying sheet made of a lower light-transmissive material and discharger 9 alone may be employed for a copying sheet made of a high light-transmissive material.

Figure 3:
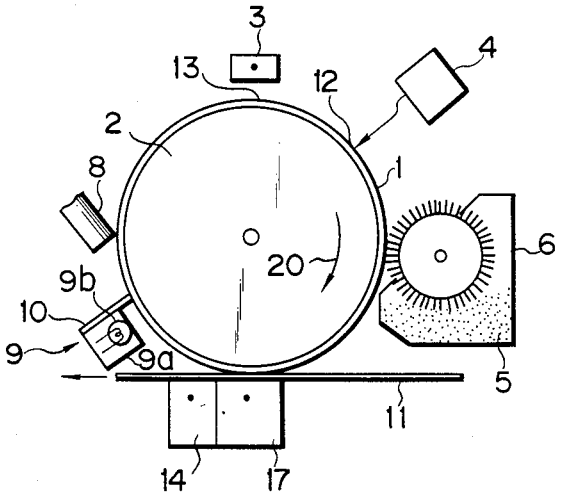

Referring to FIG. 3, light shielding plate 10 is provided between discharger 9 and cleaning blade 8 in a position adjacent to discharger 9. Light shielding plate 10 is made of an electrically insulating material, such as rubber or plastic, and is located such that one end is in contact with photoreceptor 1 to prevent the discharging light from leaking out onto the charged area of the photoreceptor. Light shielding plate 10 has an Al-evaporated reflection film on the side facing discharger 9 except for an area in contact with photoreceptor 1 and functions to reflect light emitted from discharging lamp 9*b*, for discharging purpose. The leakage of light which is emitted from discharging lamp 9*b* can be substantially completely prevented since light shielding plate 10 situated between discharger 9 and cleaning blade 8 is in contact with the surface of photoreceptor 1.

Therefore, the generation of carriers in charged area 13 may be repressed, resulting in further reduction of carrier density in charged area 13 and hence the percentage of charging potential will surely be lowered.

Light shielding plate 10 is made of an insulating material, such as plastic, and thus there is no variation in the charge on the surface of the photoreceptor 1 despite the fact that light shielding plate 10 contacts the photoreceptor 1. During the rotation of drum 2 a frictional force is employed between light shielding plate 10 and photoreceptor 1 due to the light shielding plate being in contact with the surface of the photoreceptor. However, since the light shielding plate is made of plastic or rubber and since the photoreceptor of a-Si has a Vickers' hardness of about 1000, there is no risk of the photoreceptor surface being worn by the light shielding plate. Furthermore, the light from discharging lamp 9*b* can be reflected on the aforementioned Al-evaporated reflection film of the light shielding plate, thus enhancing the discharging efficiency.

Figure 4:
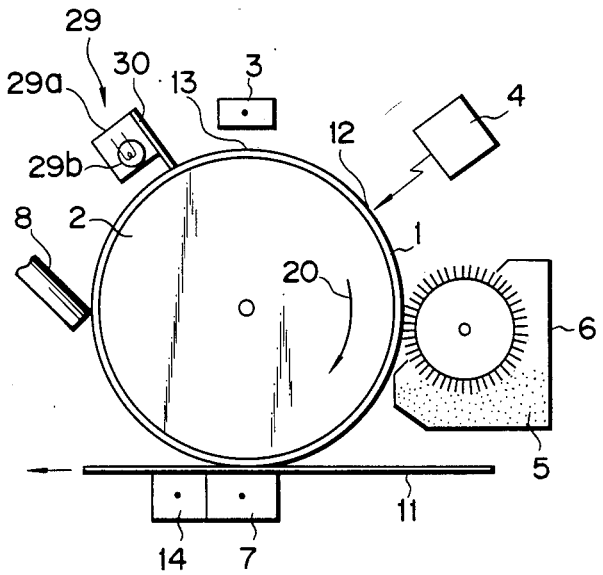

Referring to FIG. 4, charger 3, exposure unit 4, developing unit 6, transfer charger 7, separating charger 14, cleaning blade 8 and discharger 29 are arranged, in the mentioned order, around the drum 2. Discharger 29 has box 29*a* in which discharging lamp 29*b* for emitting discharging light onto the surface of photoreceptor 1 is placed.

Light shielding plate 30, which is substantially the same as light shielding plate 10 shown in FIG. 3, is provided between discharger 29 and charger 3 in a position adjacent to discharger 29.

The leakage of light which is emitted from discharging lamp 29*b* may be substantially completely prevented since light shielding plate 30 situated between discharger 9 and charger 3 is in contact with the surface of photoreceptor 1.

Therefore, in this case too, the generation of carriers in charged area 13 can be repressed, resulting in reduction of carrier density in charged area 13 and hence the percentage of charging potential will be lowered.

In this embodiment, the drum takes about 1 second to make one rotation and, if 0.24 seconds or over is left from the discharging to the next charging of the photoreceptor surface, then the charging potential at said next charging step can be set to a predetermined level.

Although, in this embodiment, photoreceptor 1 is all made of a-Si, it may be formed of a material, such as plastics, except for a latent image formation area of the photoreceptor.

In place of the light shielding plate use may be made of any other member, such as the light shielding box with a light shielding lamp held therein.

Although the light shielding plate has been explained as being made of rubber or plastic, it is not restricted thereto. For example, use may be made of an electrically insulating material whose hardness is lower than that of a-Si.

What is claimed is:

1. An electrophotographic apparatus, comprising:
a photoreceptor comprising amorphous silicon;
means for charging a surface area of the photoreceptor;
means for forming an electrostatic latent image on the surface area of the photoreceptor;
means for developing the latent image by a developing agent into a visual image;
means for transferring the visual image onto a copying sheet;
cleaning means for removing the agent remaining of the surface area of the photoreceptor after the image transfer has been performed by said transfer means;
means for discharging the surface area of the photoreceptor by a light illumination, said discharging means including a lamp for directing light onto the surface area of said photoreceptor for illumination; and
light shielding means for shielding the light directed from said discharging means onto the surface area of the photoreceptor which has been charged by said charging means, said light shielding means including a plate-like shielding member located in contact with the surface of said photoreceptor and at least a portion of said light shielding member, which is in contact with said photoreceptor, is made of an electrically insulating material.

2. An electrophotographic apparatus according to claim 1, wherein said discharging means is located next said cleaning means and discharges the surface area of said photoreceptor after said developing agent has been removed by said cleaning means.

3. An electrophotographic apparatus according to claim 2, wherein said light shielding means is located between said discharging means and said charging means.

4. An electrophotographic apparatus according to claim 1, wherein said discharging means is located before said cleaning means and discharges the surface area of the photoreceptor before said remaining agent on the surface of said photoreceptor is removed by said cleaning means.

5. An electrophotographic apparatus according to claim 4, wherein said light shielding means is located between said discharging means and said cleaning means.

6. An electrophotographic apparatus according to claim 4, in which said light shielding means is located between said cleaning means and said charging means.

7. An electrophotographic apparatus, comprising:
a photoreceptor comprising amorphous silicon;
means for charging a surface area of the photoreceptor;
means for forming an electrostatic latent image on the surface area of the photoreceptor;
means for developing the latent image by a developing agent into a visual image;
means for transferring the visual image onto a copying sheet;
means for removing the agent remaining of the surface area of the photoreceptor after the image transfer has been performed by said transfer means;
means for discharging the surface area of the photoreceptor by a light illumination, said discharging means including a lamp for directing light onto the surface area of said photoreceptor for illumination; and
light shielding means for shielding the light directed from said discharging means onto the surface area of the photoreceptor which has been charged by said charging means, said light shielding means including a plate-like shielding member of such a type that at least a portion thereof in contact with said photoreceptor is made of a material whose hardness is lower than that of amorphous silicon.

8. An electrophotographic apparatus according to claim 7, wherein said light shielding member is of such a type that at least a portion thereof in contact with said photoreceptor is formed of an electrically insulating, non-transmissive rubber or plastic.

9. An electrophotographic apparatus according to claim 7, wherein said discharging means is located next to said removing means and discharges the surface area of said photoreceptor after said developing agent has been removed by said removing means.

10. An electrophotographic apparatus according to claim 9, wherein said light shielding means is located between said discharging means and said charging means.

11. An electrophotographic apparatus according to claim 7, wherein said discharging means is located before said removing means and discharges the surface area of the photoreceptor before said remaining agent on the surface of said photoreceptor is removed by said removing means.

12. An electrophotographic apparatus according to claim 11, wherein said light shielding means is located between said discharging means and said removing means.

13. An electrophotographic apparatus according to claim 11, wherein said light shielding means is located between said removing means and said charging means.

14. An electrophotographic apparatus, comprising:
a photoreceptor comprising amorphous silicon;
means for charging a surface area of the photoreceptor;
means for forming an electrostatic latent image on the surface area of the photoreceptor;
means for developing the latent image by a developing agent into a visual image;
means for transferring the visual image onto a copying sheet;
means for removing the agent remaining of the surface area of the photoreceptor after the image transfer has been performed by said transfer means;
means for discharging the surface area of the photoreceptor by a light illumination, said discharging means including a lamp for directing light onto the surface area of said photoreceptor for illumination; and light shielding means for shielding the light directed from said discharging means onto the surface area of the photoreceptor which has been charged by said charging means, said light shielding means including a plate-like shielding member of such a type that a reflection film is formed at least on that portion thereof where said discharging means is provided.

15. An electrophotographic apparatus according to claim 14, wherein said reflection film is formed of aluminum.

16. An electrophotographic apparatus according to claim 14, wherein said discharging means is located next to said removing means and discharges the surface area of said photoreceptor after said developing agent has been removed by said removing means.

17. An electrophotographic apparatus according to claim 16, wherein said light shielding means is located between said discharging means and said charging means.

18. An electrophotographic apparatus according to claim 14, wherein said discharging means is located before said removing means and discharges the surface area of the photoreceptor before said remaining agent on the surface of said photoreceptor is removed by said removing means.

19. An electrophotographic apparatus according to claim 18, wherein said light shielding means is located between said discharging means and said removing means.

20. An electrophotographic apparatus according to claim 18, wherein said light shielding means is located between said removing means and said charging means.

* * * * *